United States Patent [19]

Bessay

[11] Patent Number: 4,470,755

[45] Date of Patent: Sep. 11, 1984

[54] GUIDE BLADE SET FOR DIVERGING JET STREAMS IN A STEAM TURBINE

[75] Inventor: Raymond Bessay, Belfort, France

[73] Assignee: Alsthom-Atlantique, Paris, France

[21] Appl. No.: 370,715

[22] Filed: Apr. 22, 1982

[30] Foreign Application Priority Data

May 5, 1981 [FR] France ..... 81 08884

[51] Int. Cl.[3] ..... F01D 5/12

[52] U.S. Cl. ..... 415/191; 415/181; 415/119; 415/DIG. 1; 415/207; 416/223 A

[58] Field of Search ..... 415/192, 181, 191, 119, 415/DIG. 1, 207, 208, 210, 212 R; 416/180, 237, 223 A, 223 R

[56] References Cited

U.S. PATENT DOCUMENTS

| | | | |
|---|---|---|---|
| 850,200 | 4/1907 | Ahlquist | 415/191 |
| 1,062,258 | 5/1913 | Schlotter | 415/119 |
| 1,966,787 | 7/1934 | Buri . | |
| 2,029,813 | 2/1936 | De Mey . | |
| 2,154,313 | 4/1939 | McMahan . | |
| 2,795,373 | 6/1957 | Hewson . | |
| 3,316,714 | 5/1967 | Smith et al. | 415/191 |
| 3,989,406 | 11/1976 | Bliss | 415/181 |
| 4,075,500 | 2/1978 | Oman et al. | 415/DIG. 1 |
| 4,131,387 | 12/1978 | Kazin | 415/181 |
| 4,172,361 | 10/1979 | Kronogard . | |

FOREIGN PATENT DOCUMENTS

| | | | |
|---|---|---|---|
| 503596 | 6/1954 | Canada | 415/192 |
| 1037610 | 9/1953 | France . | |
| 1499693 | 10/1967 | France . | |
| 2077376 | 10/1971 | France . | |
| 2365692 | 4/1978 | France . | |
| 54-45405 | 4/1979 | Japan | 415/DIG. 1 |

*Primary Examiner*—Stephen Marcus
*Assistant Examiner*—Brian J. Bowman
*Attorney, Agent, or Firm*—Sughrue, Mion, Zinn, Macpeak, and Seas

[57] ABSTRACT

A guide blade set for diverging jet streams in a steam turbine which has blades (2, 2') whose concave and convex surfaces are orthogonal firstly to the jet stream floor plate (3) and secondly to the jet stream passage ceiling plate (4) at their respective ends.

Efficiency is improved by reducing losses in the neighbourhood of the jet stream ceiling plate.

2 Claims, 7 Drawing Figures

GUIDE BLADE SET FOR DIVERGING JET STREAMS IN A STEAM TURBINE

The present invention relates to a guide blade set for diverging streams in a steam turbine which has blades disposed between a floor plate and a ceiling plate which together with the blades define the slow path for said stream, and in which the blades have convex and concave surfaces that are substantially orthogonal to the floor plate at their juncture therewith.

BACKGROUND OF THE INVENTION

In known guide vanes, the convex surfaces and the concave surfaces of the blades are constituted by substantially rectilinear generator lines which are orthogonal to the floor plate and form an angle of nearly $90°+\theta$ with the ceiling plate, where $\theta$ is the angle of divergence of the stream.

SUMMARY OF THE INVENTION

In such blade sets, secondary losses are high near the tops of the blades. To reduce these losses, the present invention provides a guide blade set for diverging streams in a steam turbine which has blades disposed between a floor plate and a ceiling plate, wherein the blades are curved such that the concave and convex surfaces of said blades are substantially orthogonal to the jet stream ceiling plate at their juncture therewith.

BRIEF DESCRIPTION OF THE DRAWINGS

The present invention will be better understood from the following description and from the accompanying drawings, in which.

MORE DETAILED DESCRIPTION

A turbine in accordance with the invention has a succession of stationary and moving blade sets.

A guide blade set 1 of a last stage has blades 2 disposed between a cylindrical floor plate 3 and a conical ceiling plate 4 which forms an angle $\theta$ with the axis OO' of the turbine.

Said angle $\theta$ is particularly wide for the last stage of the low-pressure part of the turbine. Also, when it is required to use moving end blades which are high, said angle is even wider.

In known turbines, the angle $\theta$ at the guide blade set of the last stage usually lies between 25° and 70°.

Figure 1:
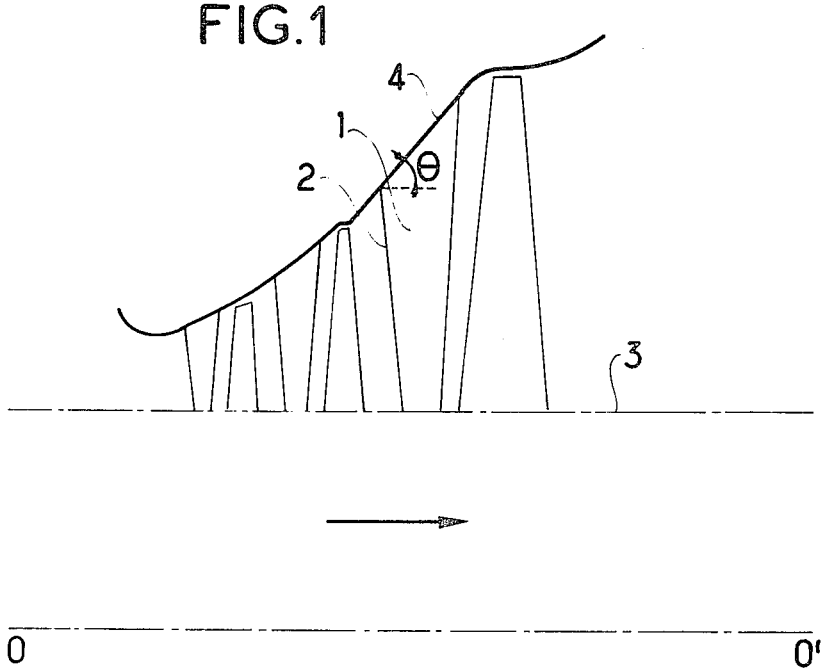
PRIOR ART FIG.1
FIG. 1 is an axial cross-section through a diverging flow steam turbine with diverging streams.
Figure 2:
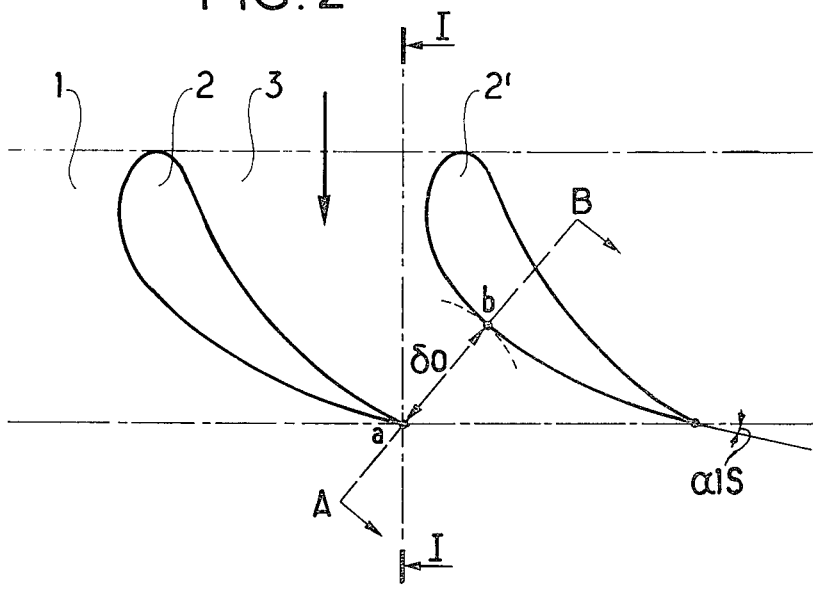
PRIOR ART FIG.2
FIG. 2 is a plan seen from above of the guide blade set.

FIG. 2 is a plan of the guide blade set 1 seen from above, showing two consecutive blades 2 and 2'.

The flow passage 3 is delimited by the concave surface of the blade 2, the convex surface of the blade 2', the ceiling plate and the floor plate.

The minimum distance $\delta O$ between the two neighbouring plates 2, 2' goes from the end a of the trailing edge of the blade 2 to a point b on the convex surface of the blade 2'.

A circle whose centre is said end a and whose radius is $\delta$ is tangential at said point b to the convex surface of the blade 2'.

The minimum flow passage cross-section between the two consecutive blades 2 and 2' is defined by the entire height of the two blades and the top and bottom segments a-b.

Figure 3:
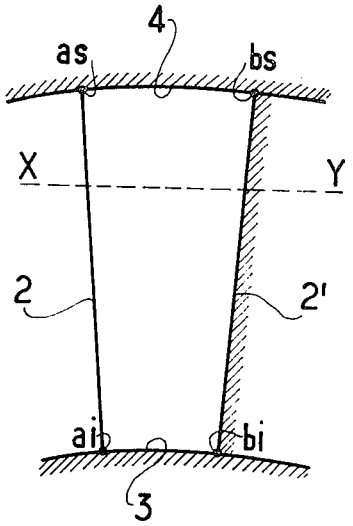
PRIOR ART FIG. 3
FIG. 3 is a cross-section along line A—B of FIG. 2 for a stream passage which is cylindrical.

When the angle $\theta$ is negligible, said minimum flow passage cross-section is substantially in the shape of a sector of an annulus ai-bi-bs-as (ai and bi being on the floor plate, and as and bs being on the ceiling plate) comprised between the floor plate 3, the ceiling plate 4, the trailing edge of the blade 2 and the convex surface of the blade 2' (see FIG. 3).

Any cylindrical cut XY around the axis of the turbine in the case of FIG. 3 meets all these blades whatever the point at which said cut is made up the height of the blades.

Figure 4:
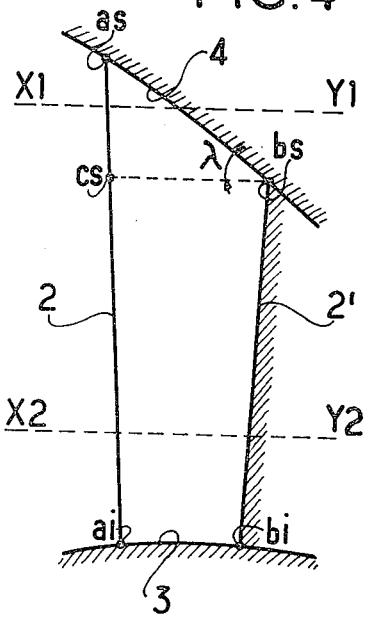
PRIOR ART FIG. 4
FIG. 4 is the same cross-section as FIG. 3 for a stream passage which is divergent.

When the angle $\theta$ is wide, the flow passage minimum cross-section is in the form of a quadrilateral ai-bi-bs-as (neglecting the curvature of ai-bi on the floor plate 3 and of as-bs on the ceiling plate 4) which differs mainly from the cross-section illustrated in FIG. 3 by the triangle as-bs-cs, where bs-cs is traced parallel to ai-bi (see FIG. 4).

The smaller the exit angle $\alpha$ 1S formed between the outlet of the stream and the rear of the blade set, the closer the angle $\lambda$ at bs in the triangle as-bs-cs- is to the angle $\theta$.

Indeed, the smaller $\alpha$ 1S, the more the cross-section passing through a and b resembles cross-section I—I.

Any cylindrical cross-section XY (e.g. X2—Y2) which passes through the turbine shaft at a level lower than bs-cs meets the blades.

Figure 5:
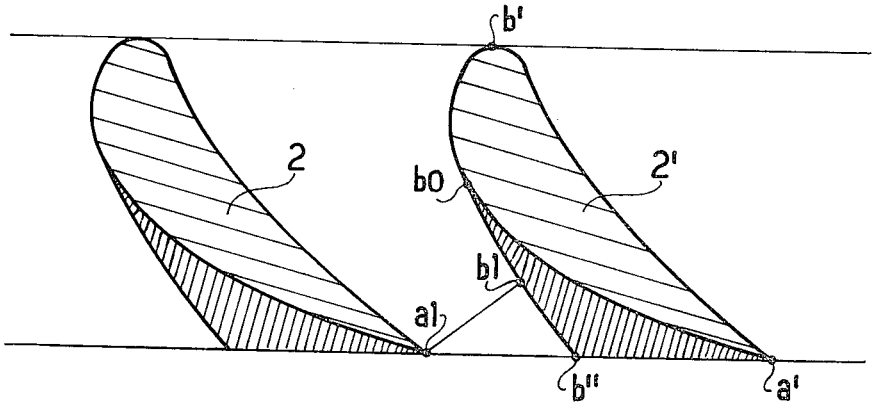
PRIOR ART FIG. 5
FIG. 5 is a cross-section at the level X1—Y1 of FIG. 4.

In contrast, any cross-section XY such as X1 Y1 made on the portion of the blade between as and cs passes through the blade 2 but no longer passes through the blade 2' (see said cross-section in FIG. 5).

The flow passage cross-section is determined firstly by the concave surface of the blade 2 and secondly by the convex surface of the blade 2' in a first part b'-bo; then by the ceiling plate from bo to b".

In particular, because of the extra thickness bO-b"-a' where a' is the intersection of the trailing edge of the blade 2' by the cylinder X1 Y1 (where X1 Y1 lies between as and cs), great losses occur when the steam which passes through the triangle as bs cs expands.

Figure 6:
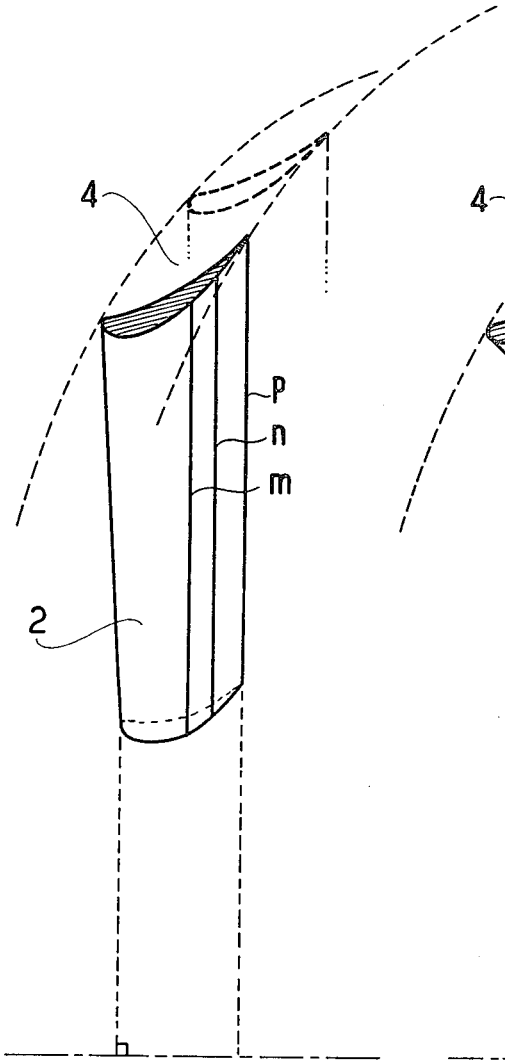
PRIOR ART FIG. 6
FIG. 6 is a perspective view of a conventional blade.

FIG. 6 illustrates a conventional blade. The convex and concave surfaces are orthogonal to the floor plate at their juncture therewith and form an angle of $\theta+90°$ with the ceiling plate 4. The successive profiles of the blades are connected together by lines such as m, n and p which are always nearly straight.

Figure 7:
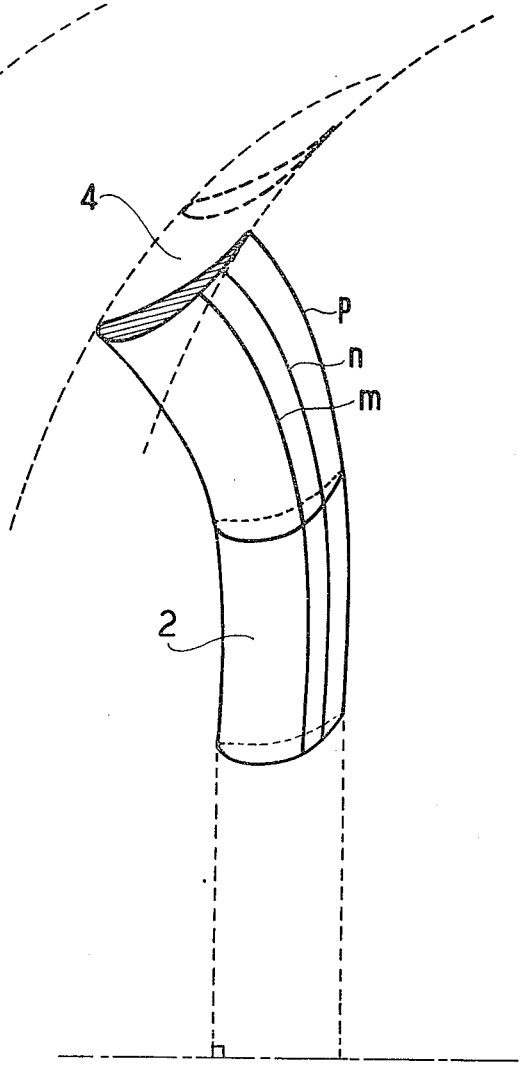
FIG. 7 is a perspective view of a blade in accordance with the invention.

A blade in accordance with the invention is illustrated in FIG. 7. The convex and concave surfaces are also orthogonal to the floor plate at their juncture therewith. The blade is straight, up to an intermediate profile I, and is then sufficiently curved longitudinally for the convex and concave surfaces also to be orthogonal to the ceiling plate at their juncture therewith.

In the guide blade set in accordance with the invention, the triangles as bs cs have practically disappeared and efficiency is thereby improved compared with conventional guide blades.

I claim:

1. A guide blade set for diverging streams in a steam turbine, said turbine comprising a floor plate and a ceiling plate spaced from said floor plate, blades being disposed between said floor plate and said ceiling plate, said floor plate extending generally parallel to the axis of the turbine, and said ceiling plate being conical and forming a diverging angle with the axis of the turbine in the direction of steam flow, the improvement wherein the blades are curved longitudinally such that concave and convex surfaces of said blades at one end are orthogonal to the jet stream floor plate at their juncture therewith and at the other end are orthogonal to the jet stream ceiling plate at their juncture therewith.

2. The guide blade set as claimed in claim 1, wherein the blades are straight from the floor plate for a distance substantially beyond the floor plate and terminate in curved portions whose ends remote from the floor plate contact the jet stream ceiling plate, and wherein the change between the straight section and the curved section of said blades in closer to the ceiling plate than to said floor plate.

* * * * *